United States Patent [19]

Fishman et al.

[11] Patent Number: 5,007,182

[45] Date of Patent: Apr. 16, 1991

[54] BODY DRYER

[76] Inventors: Sam Fishman, 6 Amberly Ct., Marlboro, N.J. 07746; Michael J. Marchese, 12812 Willoughby La., Bayonet Point, Fla. 34667

[21] Appl. No.: 473,019

[22] Filed: Jan. 31, 1990

[51] Int. Cl.[5] ..... F26B 19/00

[52] U.S. Cl. ..... 34/90; 34/202; 34/233; 34/243 R; 392/380

[58] Field of Search ..... 34/90, 91, 201, 202, 34/243 R, 239; 219/366, 369, 370, 371, 217, 373, 374, 262, 353

[56] References Cited

U.S. PATENT DOCUMENTS

| | | | |
|---|---|---|---|
| 1,658,489 | 2/1928 | Lindstrom | 34/239 |
| 2,953,805 | 9/1960 | Sevenich | 34/239 |
| 3,054,129 | 9/1962 | Dragoon | 34/239 |
| 4,258,248 | 3/1981 | Campo | 34/243 R |
| 4,677,764 | 7/1987 | Cerny | 34/202 |
| 4,715,129 | 12/1987 | Uchida | 34/237 |
| 4,782,601 | 11/1988 | Gonzalez | 34/237 |

*Primary Examiner*—Henry A. Bennett
*Assistant Examiner*—Denise L. F. Gromada
*Attorney, Agent, or Firm*—Blum Kaplan

[57] ABSTRACT

A body dryer especially suitable as a portable body dryer is provided. A platform for supporting the feet of the user is formed with apertures therethrough and an upwardly extending surface portion at least in the region of the user's toes to spread same. An upwardly extending region along the central longitudinal axis may be provided to spread the feet of the user. A fan is provided below the platform to force air through the apertures.

24 Claims, 2 Drawing Sheets

BODY DRYER

BACKGROUND OF THE INVENTION

This invention relates to a body dryer in general, and in particular, to an easily movable human body dryer. While dryers have taken many forms, body dryers are known in the prior art as exemplified in U.S. Pat. Nos. 3,128,161 (Hudson) and 3,711,958 (Lepage). U.S. Pat. No. 3,128,161 is directed to an after shower body dryer having a stall with a series of air diffusers along the walls of the stall. This prior art device is a large bulky machine that is not easily movable and is expensive to build and install.

U.S. Pat. No. 3,711,958 is directed to a device having two fans with a porous billowy material over each fan that fills with air and expands to come in contact with the user's body, thereby toweling the user off. This invention does not eliminate the need for a towel and is also large, bulky and expensive.

U.S. Pat. No. 1,658,489 (Lindstrom) teaches an electric foot drying machine having a platform containing vent openings on the top. A baffle guides the air from a fan past a heating element and through the vents to the foot of the user. No mention is made of body drying. Apparently, this foot dryer, perhaps because of fan selection or baffle design or dimensions, is not designed to dry the user's complete body. Further, because the platform the user stands on is flat, the important area between the user's toes is not adequately dried, leading to discomfort and increasing the opportunity for athlete's feet and other fungal diseases.

U.S. Pat. No. 4,258,248 (Campo) discloses an instant hot air welcome mat. This patent suffers from the same disadvantage as U.S. Pat. No. 1,658,489, that is, it does not teach body drying but is designed to dry only one's shoes. The platform is flat and it in no way anticipates a curved platform that would spread the user's toes.

U.S. Nos. 4,492,221 (Kerley), 3,054,129 (Dragoon), 2,779,856 (Fahner) and German Patent No. 824 689 are directed to hot air devices for drying shoes. A fan is provided for directing a stream of hot air either above or below the shoes of the user. Once again, these devices do not have the ability to dry a person's body.

U.S. Pat, No. 2,139,942 (Fellipone) is directed to a bath tub having a grated platform projected from the base. Under the grated platform is one conduit for draining mositure from the body and a second conduit for conveying hot air from a hot air source up through the grate to the body. Once again, this does not provide an upwardly curving surface to allow maximum drying of the region between the toes. Further, it is not an easily movable body dryer.

U.S. Pat. No. 2,896,337 (Blythe) is directed to an egg dryer having a series of transverse rods provides at the bottom of a main frame annular ring and a fan mounted below the transverse rods. The eggs are placed along the transverse rods and supported thereon while the fan forces a stream of air up towards the eggs, thereby drying them off. This art is not directed to the drying of a body and therefore is unrelated to the instant device.

SUMMARY OF THE INVENTION

Generally speaking, in accordance with the invention, a body dryer adapted to efficientely air dry a body is provided. The dryer has four legs comprising a frame. The frame supports a platform having the capability of supporting the weight of a human. the platform is formed with apertures therethrough capable of allowing air flow such as a screen or grate. The platform is curving upwardly at least in the region supporting the toes, causing the toes of the user's feet to spread. A blower unit is supported under the platform for directing air up through the apertures toward the body. The platform can also be inclined upwardly toward a central axis of the platform to cause a spread of the feet of the user.

Accordingly, it is an object of the invention to provide an improved dryer which may be used by a person to essentially dry their entire body, and in particular the region between the toes.

Another object of the invention is to provide a dryer that is small and lightweight, thus creating an easily movable body dryer of relatively simple and inexpensive construction.

Still another object of the invention is to provide a dryer which is simple to operate.

A further object of the invention is to provide a body dryer that is safe to use.

A still further object of the invention is to provide a dryer which eliminates the need for towels after bathing and which may provide enhanced sanitary conditions in public establishments such as health clubs.

Yet another object of the invention is to provide a rugged construction that can be used in a public establishment and be cost efficient to manufacture.

Still other objects and advantages of the invention will in part be obvious and will in part be apparent from the specification and drawings.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
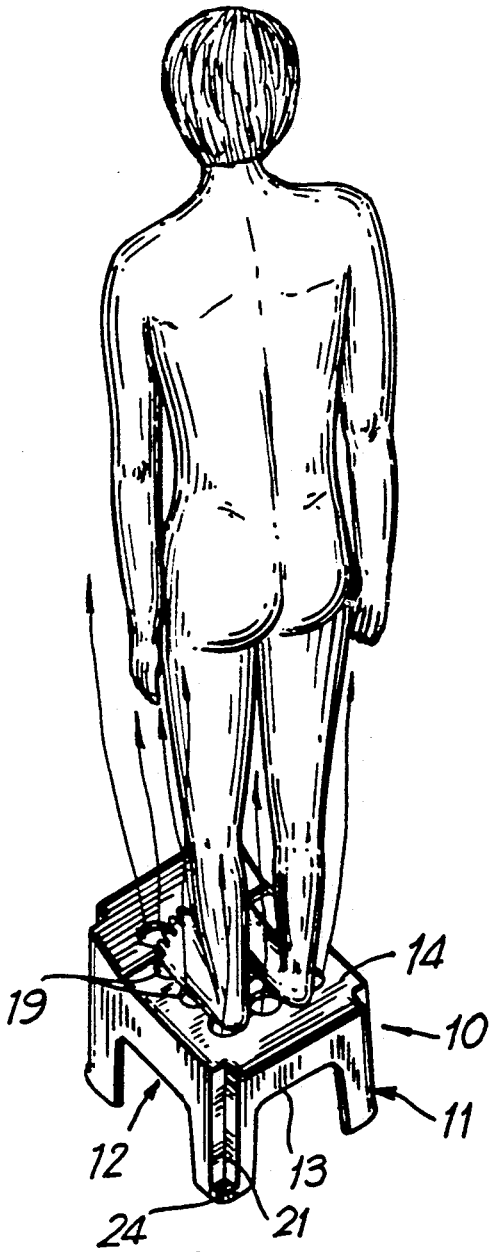
FIG. 1 is a perspective view of a body dryer in accordance with the invention showing a person operatively positioned in relation to the body dryer.

Reference is made to FIG. 1 wherein a body dryer, generally indicated as body dryer 10, is dipicted. Body dryer 10 includes legs 11 attached to a platform portion 12. Platform portion 12 consists of a lower reinforcing portion 13 which structurally supports an upper portion or platform 14 upon which the user stands. The platform 14 contains a plurality of spaced apertures 19 through which air travels.

Referring to FIGS. 1—4, the legs 11 are comprised of a rigid material such as, for example, molded plastic. Each leg 11 is designed to slope slightly outward from the center to create a broader base upon which to support the platform portion 12, creating greater stability. Each leg 11 is formed with a longitudinally extending groove 21 formed in the corner thereof substantially in the shape of a quarter circle, the groove terminating in a laterally extending bearing pad region 24. The bearing pad region provides a relatively large area for engagement with the floor to provide traction and stability to the dryer. This construction increases the surface area to the legs and increases the structural strength of the legs to add further lateral stability to the lightweight movable dryer.

Figure 2:
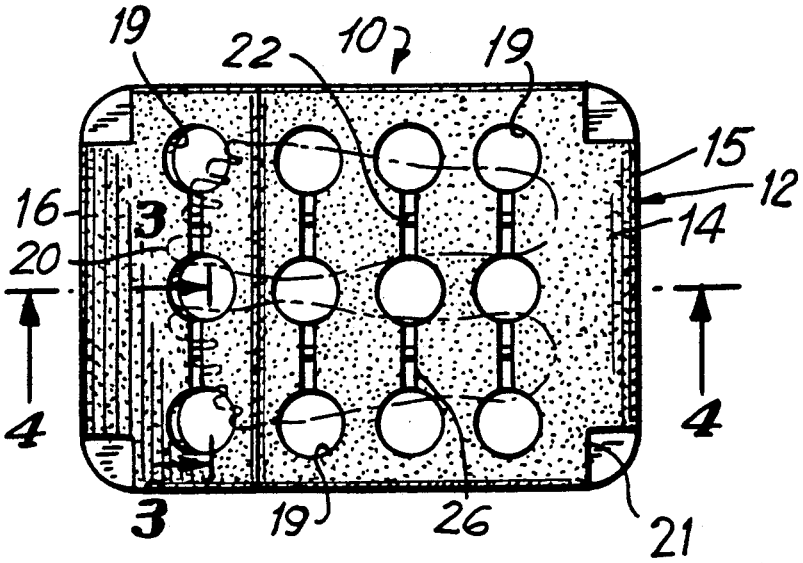
FIG. 2 is a top plan view of a body dryer in accordance with the invention showing a person operatively positioned in relation to the body dryer.
Figure 4:
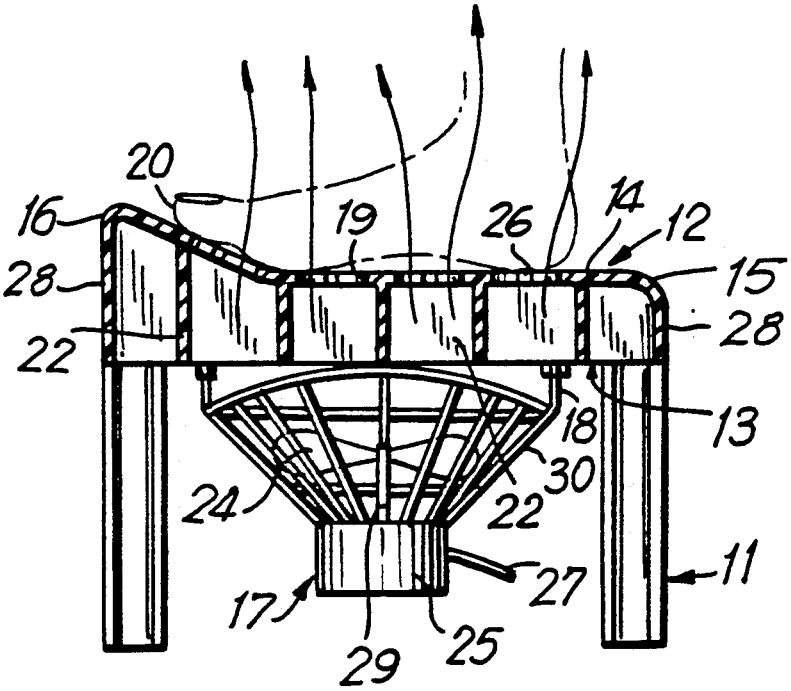
FIG.4 is a side view of a body dryer in accordance with the invention taken along line 4—4 of FIG. 2.

Particular reference is now made to FIGS. 2 and 4 wherein top and side sectional views of platform 14 are depicted. Like reference numerals are used to indentify like elements. The platform is made of a rigid insulating material such as, for example, molded plastic. The rear 16 of the platform 14 begins essentially parallel to the ground and then curves continuously upwardly to the front 15 of the platform 14. This has the effect of the bending the toes 20 upwardly, thereby spreading the user's toes to permit drying therebetween and allowing increased amounts of air to reach the user's body.

The platform 14 is formed with a pattern of large apertures 19 through which air is directed to dry the user. Slots 26 join the apertures 19 to increase airflow. While a particular pattern of apertures and slots is shown in the surface of the platform 14, that pattern and other patterns permitting adequate air flow can be used. While a particular curvature of the platform 14 is depicted, the invention is not limited to that curvature but can be formed with other slopes permitting spreading the toes of the user by having an upwardly extending portion at least in the region of the toes. The surface of platform 14 may be designed to be a non-slip surface, for example, with grooves or other roughing or texturing structures on the surface formed in the molded plastic.

Reinforcing portion 13 of platform portion 12 comprises a downwardly extending peripheral skirt 28 extending downwardly from the periphery of platform 14 and joining legs 11. In addition, a plurality of laterally extending ribs 22 bridge the skirt below the platform 12, between apertures 19, together with skirt 28, provide structural rigidity to platform 12 sufficient to support the weight of the user. The skirt and rib structure depicted in not required for the invention so long as the structure provided performs the required support function. The structure is preferably designed for injection molding of at least the platform portion 12 and possibly the legs as a unit, although the joining of components by welds or other means is permitted. The skirt and rib construction also serves to channel and direct air from fan 17 to the apertures 19 and slots 26.

The fan 17 is conventional and includes blades 24 connected to electric motor 25 by rotational connecting rod 29. The electric motor may receive energy through a line cord 27 to a power supply or the power supply may be self contained as by a battery pack, eliminating the need for line cord 27. A protective cage 30 surrounds fan blades 24 for safety. The fan is supported by supports 18 joining ribs 22 and cage 30. It has been found that a relatively inexpensive, small, lightweight fan will suffice. Specifically, a 0.35 amp. 42 watt motor is sufficient to drive a sufficient fan to perform the drying function.

Figure 3:
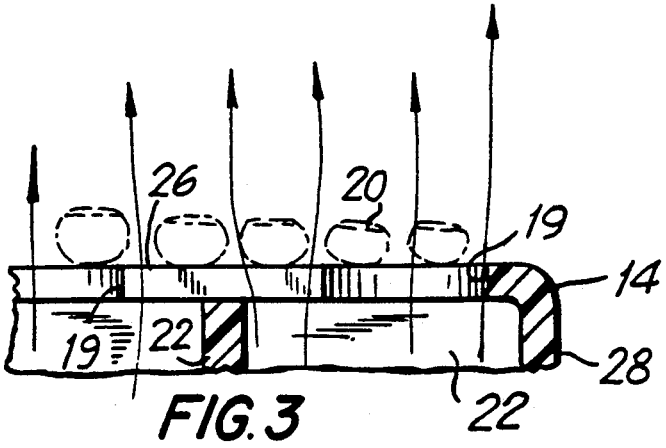
FIG. 3 is a front elevational view of a body dryer in accordance with the invention taken along line 3—3 of FIG. 2.

As shown by arrows 32 in FIGS. 3 and 4, the fan 17 directs drying air through apertures 19 and slots 26 to the user's body. The structure in accordance with the invention includes a sturdy lightweight insulating platform, a small lightweight fan unit and a curved, apertured surface to provide a simple, inexpensive and effective portable body dryer.

Figure 5:
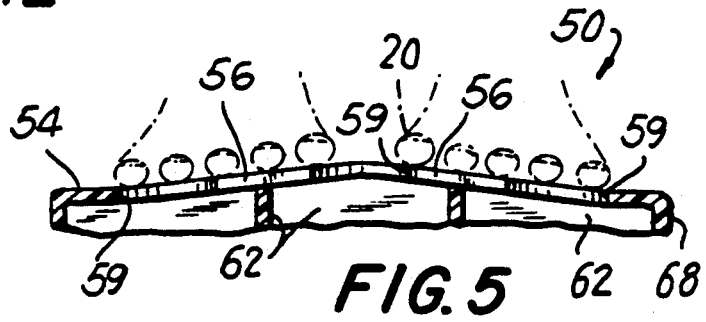
FIG. 5 is a fragmentary sectional view of the platform of an alternative embodiment of the body dryer in accordance with the invention.

Referring now to FIG. 5, a fragmentary sectional view of an alternate embodiment of the body dryer 50 in accordance with the invention is depicted. In this embodiment, in addition to having the curved region at the front of the platform 54 which tends to spread the toes 20 of the user, the platform is formed with an additional upwardly inclined top surface which extends essentially along the axis defined by sectional lines 4—4 of FIG. 2, the longitudinal central axis of the body dryer. In other words, the central region of the platform 54 along the central longitudingal axis is raised and inclines downwardly from the central region towards the periphery as shown by way of example in FIG. 5. This arrangement tends to encourage the user to position his or her feet in a slightly spread position to permit the drying air to penetrate along the inside of the legs of the user to the crotch, and to maximize the effective drying region. The embodiment of FIG. 5 includes apertures 59, slots 56, ribs 62 and skirt 68 of a structure similar to that of the embodiment of FIGS. 1-4.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for drying a user's body comprising:
a support frame;
a platform means dimensioned to permit a user to stand on a surface thereof and supported on the frame, the platform means being formed with an upwardly extending surface portion positioned to bear against and cause the toes of the user to spread, said platform means being formed with aperture means therethrough permitting airflow therethrough to the body of the user standing thereon; and
a fan means mounted under the platform means for directing air through said aperture means.

2. The apparatus of claim 1, wherein said frame means includes a plurality of legs that support said platform means and said fan means, adapted to support the weight of the user's body.

3. The apparatus of claim 1, wherein said platform means has a continuously upwardly curved surface at least in the region of the toes of the user's feet.

4. The apparatus of claim 1, wherein said aperture means includes a plurality of spaced apertures.

5. The apparatus of claim 4, wherein at least a portion of the apertures are joined by slots to increase the airflow.

6. The apparatus of claim 1, wherein the frame includes a plurality of downwardly extending rib means for supporting and providing structural rigidity to the platform means and for directing air from the fan means to the aperture means.

7. The apparatus of claim 1, wherein the surface of the platform means is irregular to increase traction.

8. The apparatus of claim 1, wherein the platform means is formed of an insulating material.

9. The apparatus of claim 8, wherein the support frame and platform means are essentially formed of a single unitary molded member.

10. The apparatus of cliam 1, wherein said fan means comprises:

a motor means;

a rotational energy connecting means;

a fan paddle means; and a protective cage means for protecting the user from injury.

11. The apparatus of claim 1, wherein the support frame, platform means and fan means are selected to be relatively lightweight and to be portable as a unit.

12. The apparatus of claim 1, wherein said platform means is additionally formed with an upwardly extending region along the central longitudinal axis thereof for tending to spread the feet of the user.

13. An apparatus for drying a user's body comprising:

a support frame;

a platform means dimensioned to permit a user to stand on a surface thereof and supported on the frame, the platform means being formed with an upwardly extending surface portion along the central longitudinal axis thereof positioned to encourage the feet of the user to spread, said platform means being formed with aperture means therethrough permitting airflow therethrough to the body of the user standing thereon; and a fan means mounted under the platform means for directing air through said aperture means.

14. The apparatus of claim 13, wherein said frame means includes a plurality of legs that support said platform means and said fan means, adapted to support the weight of the user's body.

15. The apparatus of claim 13, wherein said aperture means includes a plurality of spaced apertures.

16. The apparatus of claim 15, wherein at least a portion of the apertures are joined by slots to increase the airflow.

17. The apparatus of claim 13, wherein the frame includes a plurality of downwardly extending rib means for supporting and providing structural rigidity to the platform means and for directing air from the fan means to the aperture means.

18. The apparatus of claim 13, wherein the surface of the platform means is irregular to increase traction.

19. The apparatus of claim 13, wherein the platform means is formed of an insulating material.

20. The apparatus of claim 19, wherein the support frame and platform means are essentially formed of a single unitary molded member.

21. The apparatus of claim 13, wherein said fan means comprises:

a motor means;

a rotational energy connecting means;

a fan paddle means; and a protective cage means for protecting the user from injury.

22. The apparatus of claim 13, wherein the support frame, platform means and fan means are selected to be relatively lightweight and to be portable as a unit.

23. An apparatus for drying a user's body comprising:

a support frame;

a platform means dimensioned to permit a user to stand on a surface thereof and supported on the frame, the platform means being formed with a continuously upwardly extending curved surface portion positioned at least in the region of the toes of the user's feet to allow the toes of the user to spread, said platform means being formed with aperture means therethrough permitting airflow therethrough to the body of the user standing thereon; and a fan means mounted under the platform means for directing air through said aperture means.

24. An apparatus for drying a user's body comprising:

a support frame;

a platform means dimensioned to permit a user to stand on a surface thereof and supported on the frame, the platform means being formed with an upwardly extending surface portion positioned to allow the toes of the user to spread, in which said platform means is additionally formed with an upwardly extending region along the central longitudinal axis thereof for tending to spread the feet of the user, said platform means being formed with aperture means therethrough permitting airflow therethrough to the body of the user standing thereon; and a fan means mounted under the platform means for directing air through said aperture means.

* * * * *